US008632373B2

(12) United States Patent
Chambers

(10) Patent No.: US 8,632,373 B2
(45) **Date of Patent: *Jan. 21, 2014**

(54) FOLDABLE WATERCRAFT FIN

(76) Inventor: Tucker C. Chambers, Solana Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/459,080

(22) Filed: Apr. 28, 2012

(65) Prior Publication Data

US 2012/0210927 A1 Aug. 23, 2012

Related U.S. Application Data

(63) Continuation of application No. 12/817,620, filed on Jun. 17, 2010, now Pat. No. 8,210,888.

(60) Provisional application No. 61/187,979, filed on Jun. 17, 2009.

(51) Int. Cl.
*B63B 35/79* (2006.01)

(52) U.S. Cl.
USPC ..... 441/79; 114/347

(58) Field of Classification Search
USPC ..... 114/343, 347; 441/79
See application file for complete search history.

(56) References Cited

U.S. PATENT DOCUMENTS

| | | | | |
|---|---|---|---|---|
| 3,516,100 | A | 6/1970 | Ellis | |
| 4,008,677 | A | 2/1977 | Wordell, Sr. | |
| 5,356,324 | A | 10/1994 | Cunningham | |
| 7,430,976 | B2 | 10/2008 | Ketterman et al. | |
| 7,775,173 | B2 | 8/2010 | Santarone | |
| 8,210,888 | B2 * | 7/2012 | Chambers | 441/79 |

* cited by examiner

*Primary Examiner* — Lars A Olson
(74) *Attorney, Agent, or Firm* — Acuity Law Group, P.C.; Daniel M. Chambers

(57) ABSTRACT

Foldable or collapsible watercraft fins are described. Preferred examples of such fins are foldable surfboard, paddleboard, and kayak fins, one or more of which can be attached to a surfboard, paddleboard, or kayak.

7 Claims, 7 Drawing Sheets

10
20
30
40
50
60
61
A.
B.

c.

d.

FOLDABLE WATERCRAFT FIN

RELATED APPLICATION

This application is a continuation of the pending U.S. patent application Ser. No. 12/817,620, filed 17 Jun. 2010, which claims the benefit of and priority to U.S. provisional patent application Ser. No. 61/187,979, filed 17 Jun. 2009, the contents of which are hereby incorporated by reference for any and all purposes.

TECHNICAL FIELD

This invention concerns improved watercraft accessories, specifically hinged (i.e., foldable) fins for watercraft such as surfboards, kayaks, and the like.

BACKGROUND OF THE INVENTION

1. Introduction

The following description includes information that may be useful in understanding the present invention. It is not an admission that any such information is prior art, or relevant, to the presently claimed inventions, or that any publication specifically or implicitly referenced is prior art.

2. Background

This invention addresses a long-standing shortcoming of surfing technology, namely the problem faced by surfers with regard to the transport and storage of surfboards having vertically mounted, securely attached fins. As those in the art will appreciate, this problem also appears in the context of other watercraft types that employ one or more fixed fins to provide directional stability while in motion over or through water.

Using surfboards as an example, this problem arises because although a surfboard itself is usually only about two inches (or five centimeters) at its thickest point (exclusive of curvature, if any), the attached fin(s) add another four to eight or more inches of height at the tail end of the board. If the fin(s), standing perpendicular to the bottom of the board, is(are) left in place on the surfboard during transport and/or storage, it(they) is(are) not only at risk of being damaged or broken during transportation or storage, the board and fin(s) together require much more storage volume than would be required if there was not a need to account for the fin(s).

The current solution to this problem is the use of removable fins. However, the removal of a surfboard's fin(s) creates other problems, including the need to carry tools to remove and reattach the fin(s), as well as the need to store the fin(s), once removed. As can be appreciated, once one removes a fin from a surfboard, the risk of losing or misplacing the fin arises. Furthermore, even if fins have not been lost, tools and time are required for fin reattachment.

3. Definitions

Before describing the instant invention in detail, several terms used in the context of the present invention will be defined. In addition to these terms, others are defined elsewhere in the specification, as necessary. Unless otherwise expressly defined herein, terms of art used in this specification will have their art-recognized meanings. In the event of conflict, the present specification, including definitions, will control.

The present invention provides patentable articles of manufacture, namely foldable watercraft fins, such as surfboard fins, as well as watercraft employing such fins, in addition to methods of making and using such fins and watercraft. A "patentable" composition, process, machine, or article of manufacture according to the invention means that the subject matter satisfies all statutory requirements for patentability at the time the analysis is performed. For example, with regard to novelty, non-obviousness, or the like, if later investigation reveals that one or more claims encompass one or more embodiments that would negate novelty, non-obviousness, etc., the claim(s), being limited by definition to "patentable" embodiments, specifically exclude the unpatentable embodiment(s). Also, the claims appended hereto are to be interpreted both to provide the broadest reasonable scope, as well as to preserve their validity. Furthermore, the claims are to be interpreted in a way that (1) preserves their validity and (2) provides the broadest reasonable interpretation under the circumstances, if one or more of the statutory requirements for patentability are amended or if the standards change for assessing whether a particular statutory requirement for patentability is satisfied from the time this application is filed or issues as a patent to a time the validity of one or more of the appended claims is questioned.

A "plurality" means more than one.

SUMMARY OF THE INVENTION

This invention addresses the shortcomings noted above by allowing a watercraft fin (e.g., a surfboard fin) to be folded while it is attached to the watercraft. Thus, the present invention provides patentable articles of manufacture, namely foldable watercraft fins, such as surfboard fins, as well as watercraft employing such fins, in addition to methods of making and using such fins and watercraft. In the folded (or collapsed) position a portion of a fin according to the invention may be proximate to or even in contact with the bottom of the watercraft. As will be appreciated, most preferred are configurations wherein the fin(s) is(are) folded into a position that minimizes the height that the fin(s), once folded, protrude above the bottom surface of the board. Indeed, in some embodiments the folded portion of a fin is substantially parallel to the craft's bottom, thereby reducing its profile, and the distal surface of the folded fin may even contact the underside of the watercraft (e.g., surfboard). In preferred embodiments, a folded fin may protrude less than about three inches, preferably less than about two inches, and in some embodiments, even less than about 1.75 inches, about 1.5 inches, about 1.25 inches, about 1 inch, about 0.75 inches, and about 0.5 inches from the bottom of the watercraft.

Upon examination of this specification, it will be apparent to those in the art that the foldable fins of the invention allow for easier and more manageable watercraft storage, allowing for more surfboards, paddleboards, kayaks, or other watercraft to be stored in less space. Also, with the fins folded (and, in some embodiments, locked in place, if desired) they are less vulnerable to causing or suffering damage or breakage without having to be removed from the board. This also saves time, can prevent loss of the fins, and simplifies storage and transport.

Accordingly, it is the object of the invention to provide a watercraft fin assembly that allows the fin to be readily moved in relation to the watercraft to which it is attached, without the need for tools, between at least a folded position (for transport and storage) and an upright position.

One aspect of the invention concerns foldable fins. Such fins include a fin body and a fin base. The fin body includes a stabilizer portion and a coupling portion adapted for coupling the fin body to the fin base. When in use the stabilizer provides the fin's stabilization function for the watercraft, for example, a surfboard, to which it is attached. The coupling allows the fin body to be foldably coupled or connected to the fin base. The fin base provides for secure attachment of the foldable fin to the watercraft. The fin base includes a mount, which is a feature that allows the fin base (and fin body, when coupled to the fin base) to be securely attached to the watercraft, as well as a receiver. The fin base's receiver is adapted to receive the coupling of the fin body so that fin body can be coupled to the fin base in a desired fixed position, for example, in a folded position or an upright, or craft-stabilizing, position. Of course, and as will be appreciated by those in the art, the number and variety of positions in which the fin body can be fixedly positioned in relation to the fin base (and watercraft) will depend on many factors, including the particular fin body coupler/receiver configuration utilized in a given embodiment of the invention, the desired stabilizing position, etc.

A related aspect of the aspect of the invention concerns watercraft having at least one foldable fin of the invention fixedly secured or attached thereto. Examples of such watercraft include surfboards, paddleboards, kayaks, and the like that utilize at least one vertically mounted fin on the underside of the craft to provide stability (for example, directional stability or yaw control, rotational stability or roll control, and/or combinations thereof) while the craft is in motion through the water. The number of foldable fins will depend on the particular watercraft. For example, with regard to surfboards, any of the known fin configurations can readily be adapted to utilize one or more foldable fins according to the invention.

Another aspect of the invention concerns kits that include one or more foldable fins packaged for retail distribution and sale. Such kits will allow builders, owners, and users of finned watercraft, such as surfboards, paddleboards, and kayaks, to acquire foldable fins that can be used in constructing new finned watercraft or to retrofit existing finned watercraft currently equipped with one or more fixed, non-foldable fins.

Still other aspects concern methods of making and using foldable fins according to the invention, as well as watercraft having one or more foldable fins attached thereto.

Other features and advantages of the invention will be apparent from the following drawings, detailed description, and appended claims.

DETAILED DESCRIPTION

As those in the art will appreciate, the following detailed description describes certain preferred embodiments of the invention in detail, and is thus only representative and does not depict the actual scope of the invention. Before describing the present invention in detail, it is understood that the invention is not limited to the particular aspects and embodiments described, as these may vary. It is also to be understood that the terminology used herein is for the purpose of describing particular embodiments only, and is not intended to limit the scope of the invention defined by the appended claims.

1. Introduction

The instant invention concerns improved watercraft fins that can be folded, collapsed, or otherwise lowered or tilted when not in use in order to facilitate storage and transport as well as reduce the risk of damage or injury to the fin, other watercraft or property, or people. Generally, a watercraft has an upper portion or surface upon which a rider stands, sits, or it otherwise positioned. The bottom or underside of a watercraft contacts the water, and it is here that stabilizing fins or struts are mounted in order to provide directional stability while the craft moves through the water. For purposes of simplicity and conciseness the description below focuses on surfboard fins and surfboards; however, as those in the art will appreciate, the instant invention can readily be adapted for practice in conjunction with stabilizing fins useful on the full range of watercraft.

A. Surfboard Fins—Generally

Figure 1:
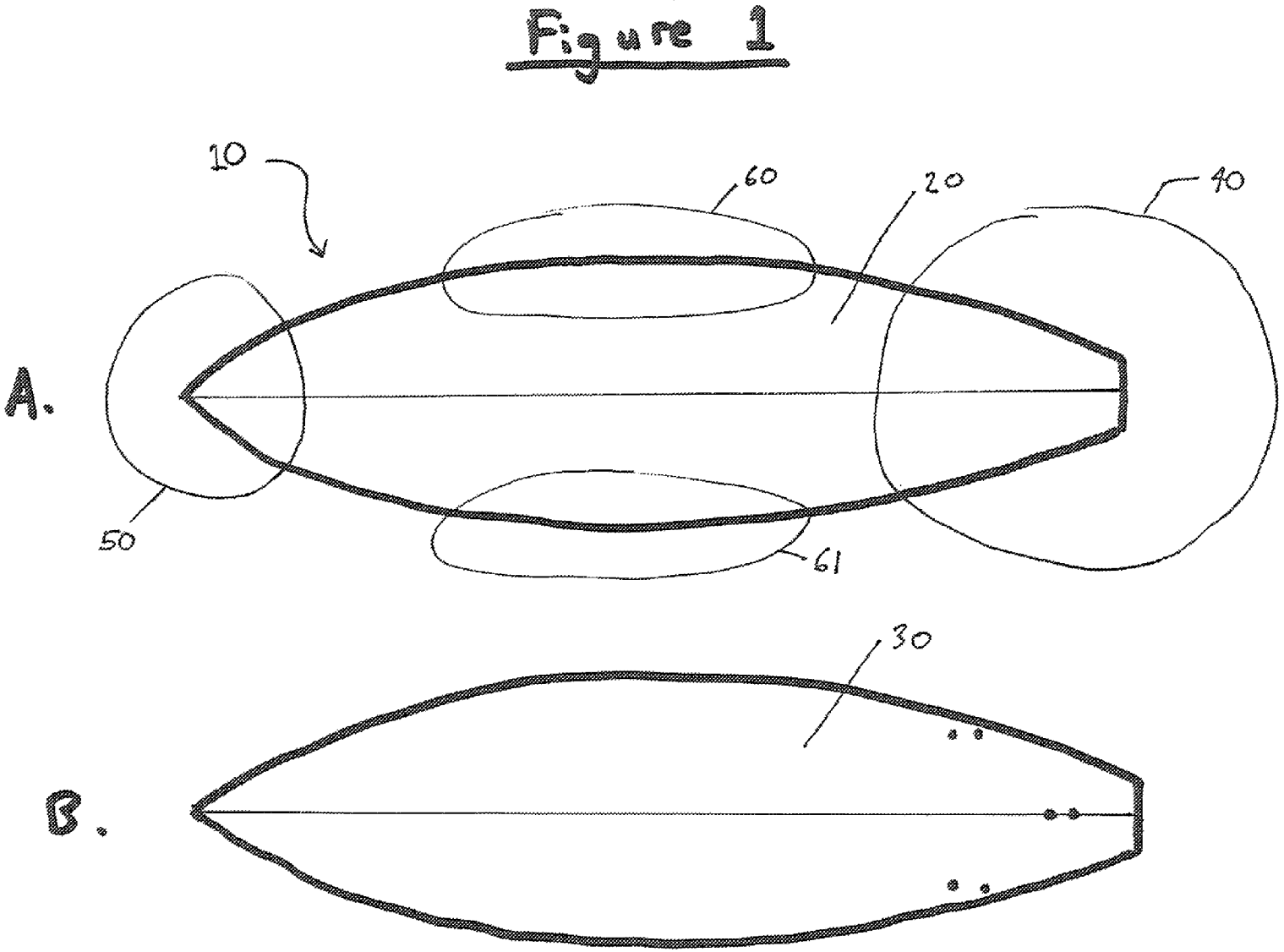
FIG. 1 has four panels, A-D, depicting a conventional tri-fin, or "thruster" surfboard. Panel A is a view from above; panels B and C are views from below; and panel D is a side view.
Figure 1:
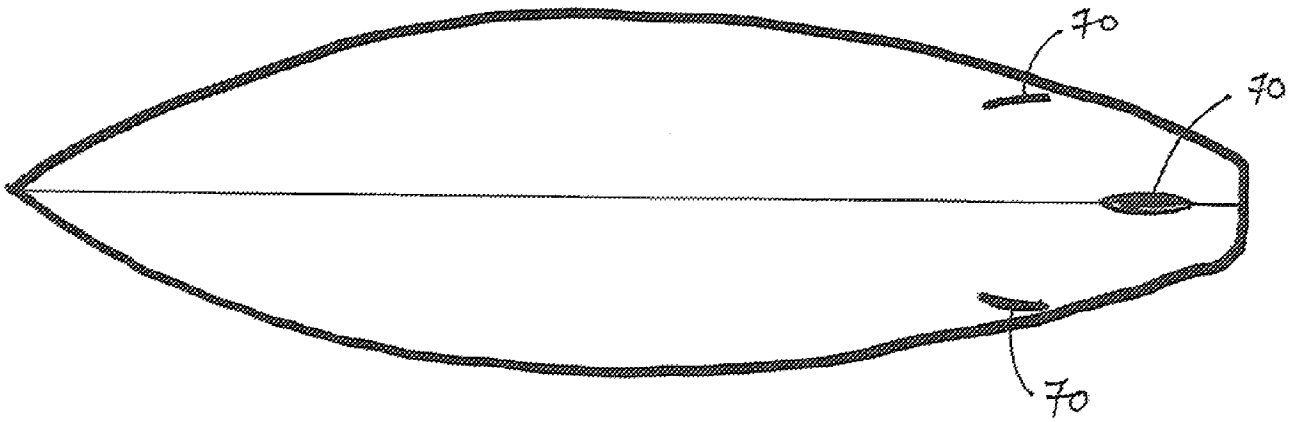
Figure 1:
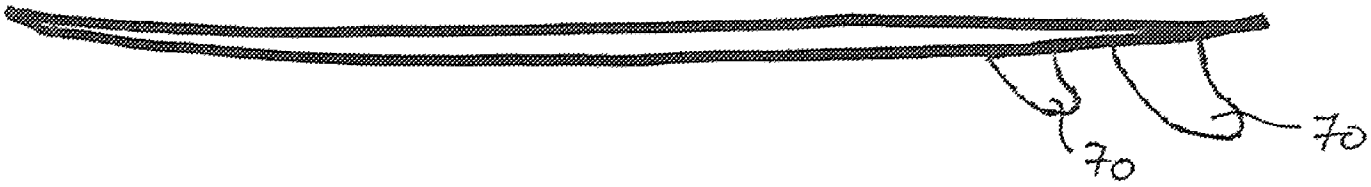

For purposes of nomenclature in the context of surfboards and with reference to FIG. 1, a surfboard (10) has a "deck" (20), which is the topside of the board where the surfer stands to surf and lays to paddle. The bottom (30) is opposite the deck and is the surface that primarily contacts the water. The "tail" (40) is at the back of the board, whereas the "nose" (50) is understood to be the front of the board and usually is slightly curved upward so that its tip (51) is above the water; the distal portion of the tail also often has a slight upward rocker, or curvature. The "rails" (60 and 61) are the edges of the surfboard that run from the tail to the nose and are where the deck and the bottom meet. Fins (70; see FIGS. 1(C) and (D)) are attached to the bottom of the surfboard near the tail.

Generally speaking, a watercraft fin such as a surfboard fin is a vertical stabilizing strut fixed to the craft's rear underside to prevent it from sliding sideways while the board is in motion over or through the water; in other words, it provides directional stability and yaw control. As those in the art appreciate, under load (for example, during a turn) a fin can flex from the vertical (or from the initial angle from vertical for an outboard fin mounted such that it is canted); the particular amount and arc of flexion depends upon many factors, including fin shape, size, and construction, board size, turn intensity, surfer skill and strength, etc.

The first reports of surfboards having with a fin (also known as a "skeg" or "skag") were in the 1930's, and those boards were much more stable than earlier boards lacking a fin. Surfboards having twin fins were introduced in the 1970's, allowing even better control and turning capability. Each fin in a twin fin pair is typically of the same size and shape, and each mirrored the other's position on the bottom of the board, with the center stringer (or the board's centerline generally) acting as the plane of symmetry.

Surfing was revolutionized in the 1980's with the introduction of the three-fin, or "thruster" configuration (see FIG. 1), with a third fin positioned centrally between and rearward in relation to a pair of (usually smaller) twin fins. This configuration is now common on many surfboard types and sizes, as it combines the capability for carving turns as well as providing enhanced control and drive. As will be appreciated, any fin figuration, be it a single or twin fin design, a thruster, or 4, 5, or more fins, can be adapted to utilize foldable fins according to the invention.

In the early 1990's removable surfboard fin systems began to appeared. One such removable fin system is the Fin Control System ("FCS"; manufactured by Surf Hardware Int., Mona Vale, Australia); another is the Future Fin (manufactured by Future Fins Corp., Huntington Beach, Calif. 92649). The configuration illustrated in FIG. 1 shows conventional surfboard having a 3-fin FCS thruster configuration. Each fin of the depicted FCS system is inserted into two ports (31) each adapted to accept a corresponding anchor (not shown) from the fin base. As those in the art are aware, FCS is a standardized system that uses a setscrew to secure a fin, via one or more anchors in the fin's base, to corresponding ports in plugs (or fin boxes) disposed in the underside of the board. This not only allows fins to be removed or replaced with the aid of a tool (e.g., an Allen wrench, a torex wrench, or screwdriver) to loosen the set screw, but also for alteration of a board's riding characteristics by changing the material, size, and/or shape of the fin(s) used. Subsequently, a range of different fin designs, including outer fins having a single foil (typically on the fin's outer surface), a concave inside surface, and curved fins, have been introduced to further enhance performance.

Recently, bullet fins have been introduced, and are based on hydrodynamic research on the bulbous bow hull ship design. Just as with the bow of a ship, a surfboard fin creates a wave as it displaces water, and the resulting turbulence creates drag on the surfboard. A bullet fin reduces such drag by creating a new primary fin wave in front of and nearly 180 degrees out of phase with the (secondary) wave created by the conventional portion of the fin. Thus, fins having bullet designs offer performance advantages over other conventional fins. Those in the art will understand that bullet features can readily be incorporated in the foldable, collapsible fins of the invention. A representative embodiment of such foldable fins re described in more detail in Examples 1 and 2, below.

As the foregoing makes clear, surfboard fin technology has advanced in recent years, particularly with advent of removable fin systems and the use of various materials to construct fins, such as different fiberglass compositions (i.e., glass fiber and polymeric, resin-based matrix materials) and other composite materials, injection-molded plastics, and metals (e.g., cast aluminum).

Today, a surfboard can have one, two, three or more fins secured to the underside of the rear of the board. The particular fin configuration for a given board is based on a variety of criteria, including rider size, weight, and skill level; size, shape, and speed of surf to be ridden; board shape, size, weight, and type of construction, etc. Surfboard fins have several common design points. In general, a surfboard fin has a basic "template" or "outline", best exemplified by a particular fin's profile or outline shape. Many fin profiles are known, and any template can be adapted for use in accordance with the invention. A fin's surface area (i.e., the projected 2-D area of a fin's template) relates to the stability the fin provides. As those in the art aware, surfboard fins can be engineered and constructed to deliver a desired degree of flex or pliability over its length. As is known, more rigid fins are faster and directional, whereas more pliable fins provide a softer, more forgiving ride. Herein, "flex" refers to a fin's deflection from the straight, or vertical, position (as illustrated in Figure _, for example). Fins with little flex are more responsive and will have more speed and direct drive. Preferred fins have a stiffer base for drive and a more flexible tip (i.e., that portion of a fin opposite the base) for release.

"Rake" or "sweep" refers to the curve, or rearward sweep, of the fin's leading edge. The rake or sweep angle is generally measured as the angle between a vertical line drawn from the mid-point of the base and the line drawn from the mid-point of the base to the highest point on the fin. Larger sweep angles generally mean a larger turning radius, whereas less sweep provides greater pivoting capability.

A surfboard fin also has "depth" characteristics, where "depth" refers to the measurement of the fin that penetrates the water. More depth equates to more stability and hold, whereas shorter depth equates to more lateral slide. The "length" of a surfboard fin refers to the linear dimension of its "base", i.e., that portion of the fin that contacts or abuts the bottom surface of the surfboard in the region where the fin is attached to the surfboard. Base dimensions for fins designed for an average short board range from about 3 to about 5 inches, while base dimensions for long board fins often exceed 6 inches. In general, the deeper the fin and the larger its area the more control it offers. However, if a fin is too large it will cause drag and may make the surfboard harder to turn. For single fin configurations, optimum fin size ranges from about 6" to about 10" deep with a base measuring about 6" to about 8".

At present the vast majority of surfboards use a 3-fin "thruster" configuration (see FIG. 1), as such boards are both maneuverable and stable. Generally the fins in a thruster configuration are about 3.5-5" deep and have a 3" to 4" base, although in many set-ups the center fin is slightly larger (about 4" to about 8") than the two outer fins. The forward, outer fins are typically attached to the board such that their bases are neither substantially parallel to the central fin nor are the fins vertical. Instead, the outer fins are angled or canted in relation to the center of the board such that their leading edges are closer together than their trailing edges ("toe-in" in relation to the board's central stringer or centerline; typical amounts of toe-in range, for example, from about 0.5-0.25") and their tips are further apart than their bases, i.e., they are canted outward (e.g., from about 1 to about 10, 15, or 20 degrees from the vertical). These features enhance board speed and maneuverability and prevent tracking. The central rear fin is usually symmetrically foiled on both sides, whereas the front fins generally are asymmetrical, having a foil on their outer surface and a flat or other non-foil shape on the inside face to improve drive while turning. In short, today particular fin designs are tailored to achieve a specific desired feel and ride. It will be readily apparent to those in the at that such designs can be readily adapted for use with the instant invention, preferably in the design and construction of fin body elements of the foldable fins of the invention, be they intended for surfboards, paddleboards, kayaks, or other watercraft.

Conventional surfboard fins can be permanently attached to the board during its initial construction; alternatively, detachable fins can be employed. At least two general approaches have been developed for detachable fins. One of these approaches uses a single fin "box" or slot to securely retain a particular fin to the board. The other approach uses one or more slotted plugs disposed in the underside of the tail region of board adapted to receive complementary anchor posts disposed at the base of the fin.

B. Foldable Surfboard Fins

This invention concerns watercraft fins that feature a fin body that can be easily and readily folded or tilted when not in use in order to ease storage and transport of the watercraft (e.g., a surfboard), as well as decrease the risk of injury or damage to the fin or other articles. As those in the art will appreciate, any mechanical or structural configuration that allows for relative motion, for example, folding or tilting, between a fixed base structure (here, a fin base, which is secured to the underside of a watercraft) and a stabilizing element or strut (here, a fin body) but which when desired can also prevent relative motion between the base structure and stabilizing element, can be adapted for use in the context of the invention. Representative examples of mechanical or structural configurations that provide for such functionality include hinges, devices that employ detents and spring-loaded bearing members such as stainless steel ball bearings, and mechanical locking systems.

As those in the art will appreciate, the foldable fins of the invention can be used to easily and readily secure a fin body to a fin base in a plurality of different positions, including a surfing position and a folded position. As will be understood, a surfing position is one in which the fin (comprising the fin base and fin body) is positioned in relation to the surfboard for the purpose of surfing. In other words, the fin is arranged such that it is secured in relation to the surfboard in a desired position for surfing, as opposed to being positioned for storage or transport while still being attached to the board. Typically a "surfing position" means that the fin is vertically positioned in relation to the underside of the surfboard to which it is attached. For example, in order to surf a fin positioned in the center (as is the case of with a board having only a single fin or in a 3-fin thruster configuration) is typically substantially perpendicular to the underside of the board. See FIGS. 1-C and 1-D. In the context of a multi-fin design, the fins may be canted or tilted from vertical for surfing; however, any such position will be understood as being different from a folded position suited for storage or transport.

Often when a fin of the invention is folded for storage or transport one face of the fin body is substantially parallel to the underside of the surfboard; indeed, the tip of the fin body may even come into contact with a small area of the underside of the surfboard when the fin is folded. In those instances when it is anticipated that a folded fin might contact the underside of the surfboard, it may be desirable to insert a thin pliable material, such as a piece of fabric, rubber, or towel or other thin cushion in order to protect either or both of the fin and surfboard.

2. Preferred Embodiments

The present invention can readily be understood by reference to several particularly preferred foldable watercraft fin embodiments described below as examples.

EXAMPLES

The following Examples are provided to illustrate certain aspects of the present invention and to aid those of skill in the art in practicing the invention. These Examples are representative of the myriad of embodiments of the invention that will be apparent to those ordinarily skilled in the art upon review of this specification, and are in no way to be considered to limit the scope of the invention in any manner.

Example 1

Hinged Surfboard Fin

This example describes a representative example of a foldable surfboard fin (100) that employs a coupling that comprises a hinge to connect or couple a fin body (110) to the fin base (120) via a hinge pin (130). See FIGS. 2 and 3. As is known, a "hinge" is a type of bearing that connects two solid objects, here, a fin body (110) and a fin base (120), typically allowing only a limited angle of rotation between the solid objects about a fixed axis of rotation (the "geometric axis" or "axis of rotation" of the hinge). Many types of hinges are known and cab readily be adapted for use in the context of the invention, including butt hinges, continuous or piano hinges, pivot hinges, etc.

In the context of a surfboard fin the fin base (120) is attached to a surfboard by any suitable connection, including permanent attachment (as occurs with some surfboards that are manufactured to include one or more permanent, non-removable fins) or a system that allows a fin to be detached from the surfboard, such as through ports, plugs, or fins boxes disposed in the underside of the tail region of the surfboard. As those in the art appreciate, two objects connected by an ideal hinge rotate relative to each other about a fixed axis of rotation (the geometrical axis of the hinge), which can be defined by any suitable element or combination of elements (e.g., a hinge pin; two pivot posts, each on opposite sides of one of the two solid objects, which posts each protrude into a recess in the other object adapted to receive the post). Hinges may be made of flexible material or of moving components.

Figure 2:
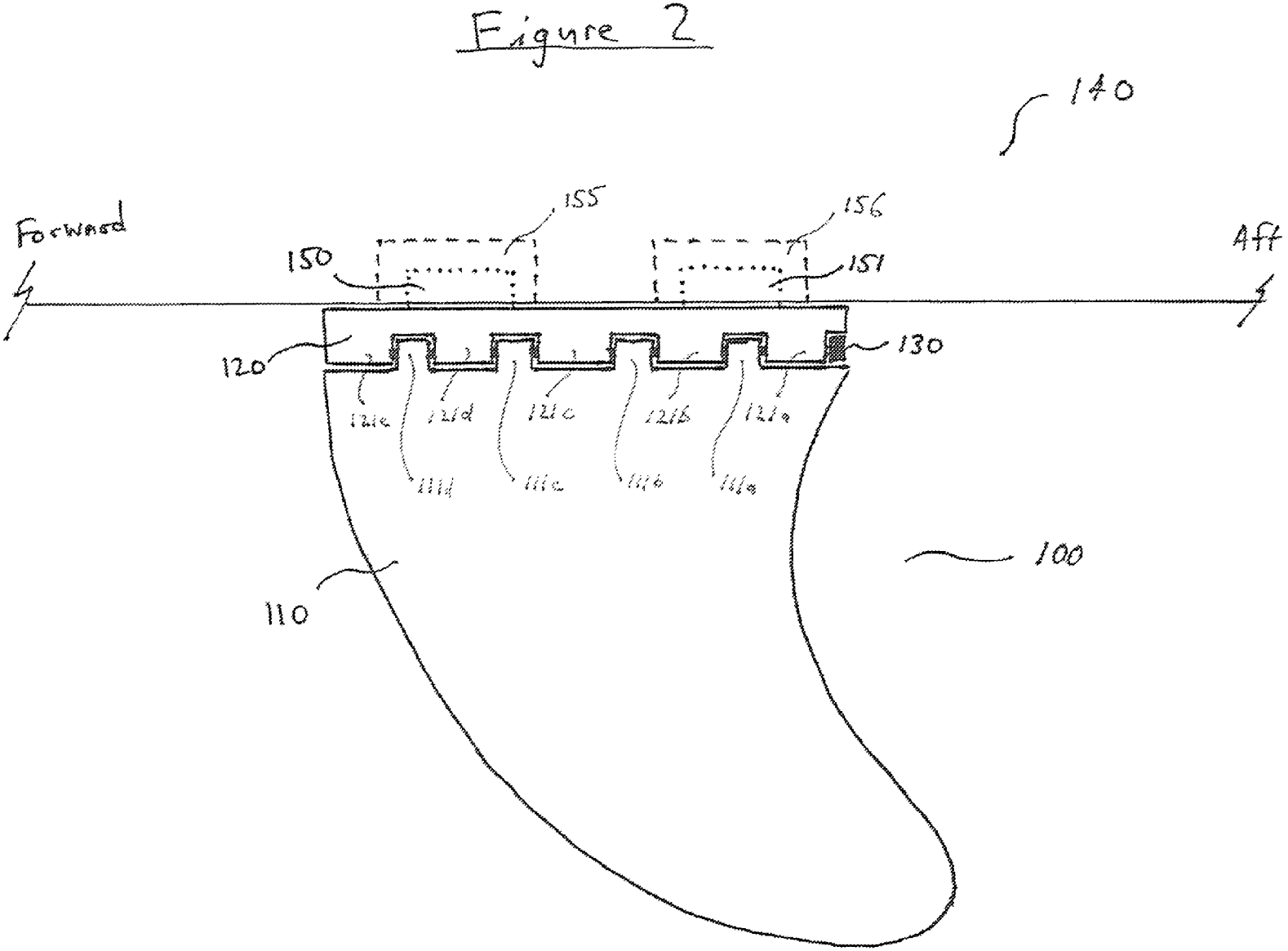
FIGS. 2-6 show various embodiments of the invention.
Figure 3:
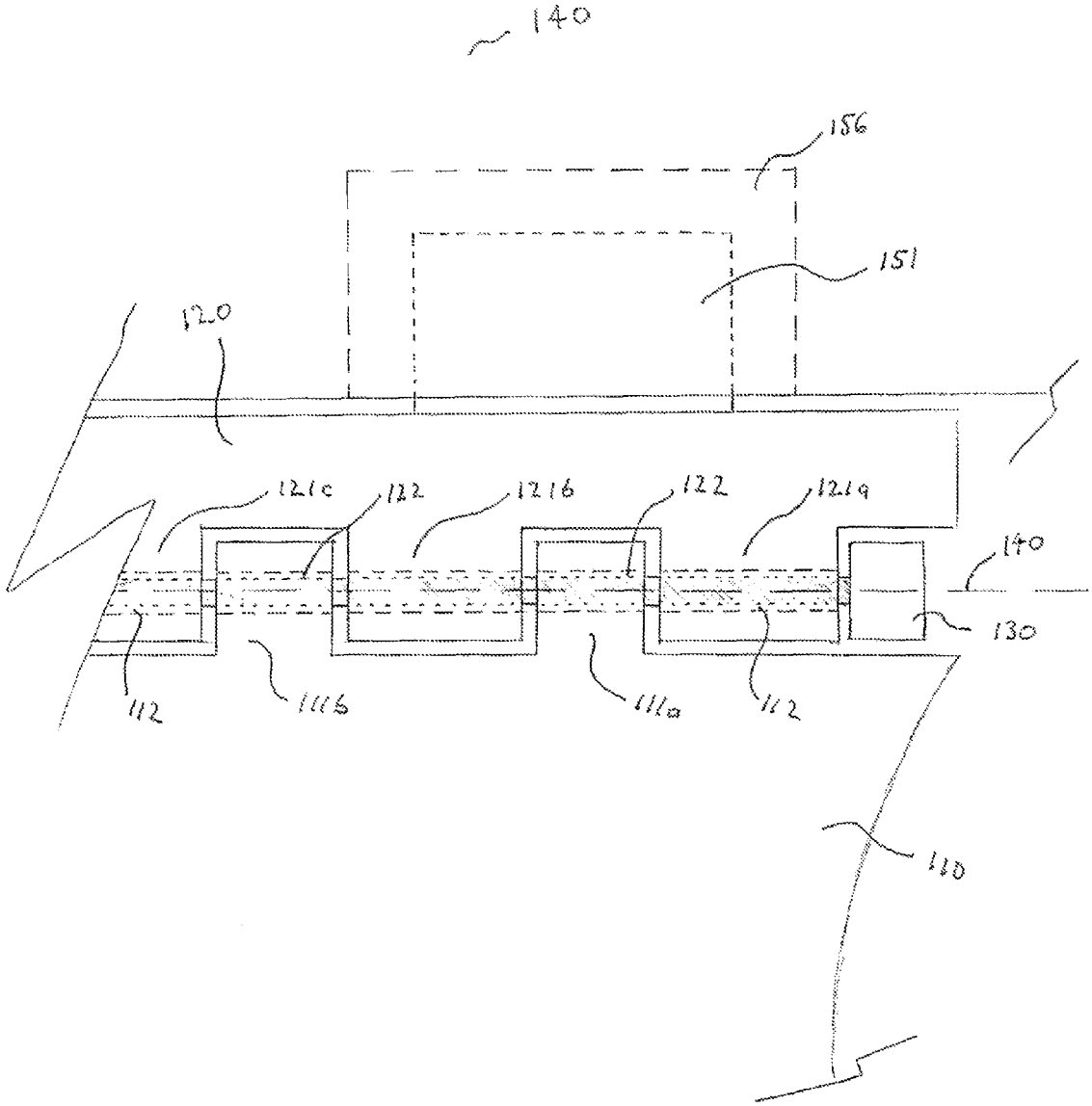

In FIGS. 2 and 3, the fin base (120) of the surfboard fin (100) is secured to the surfboard (140) via a post-anchor system, such as found in the FCS. The fin base (120) has two protruding anchoring posts (150, 151) configured to fit into recessed ports (155, 156) integrally flush-mounted into the underside of the surfboard. The fin base is secured to the surfboard by via two set screws (not shown), one of which engages one of the protruding anchoring posts (151 or 151). Using this type of configuration, the fin base (120) remains fixedly secured to the surfboard (140).

In the embodiment shown in FIGS. 2 and 3, the fin body (110) and fin base (120) are connected via a hinge pin (130). While a variety of hinge configurations can be employed, the hinge shown in these figures employs complementary coupling elements (111 and 121) integrated into the fin body (110) and fin base (120). Here, the coupling elements (111) of the fin body (each a first coupling element) and coupling elements (121) of the fin base (each a second coupling element) are boxes having a central bore (elements 112 and 122) of any desired geometry into which a complementary hinge pin (130) can be inserted when the central bores of the fin body and fin base (112, 122) are aligned in order to retain the fin base (120) and fin body (110) in fixed position relative to each other. As those in the art will appreciate, in these figures the alignment gaps between the surfboard (140) and fin base (120) are exaggerated for purposes of illustration, as are the alignment gaps between the coupling elements (111 and 121) integrated into the fin body (110) and fin base (120) and between the central bores (112 and 122) and the hinge pin (130). As will be appreciated, in actual corresponding physical embodiments, such alignment gaps are minimized.

Figure 4:
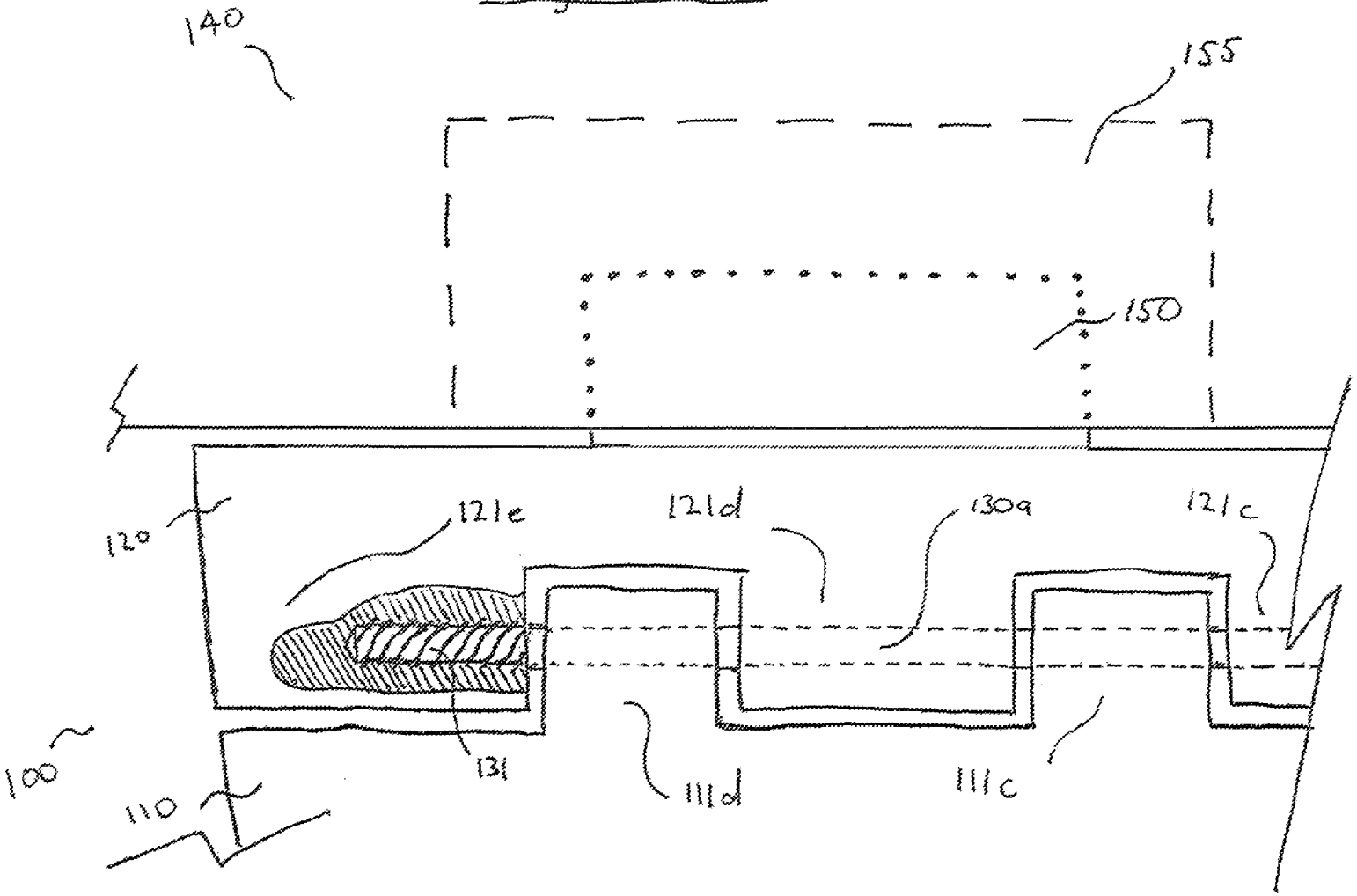
Figure 5:
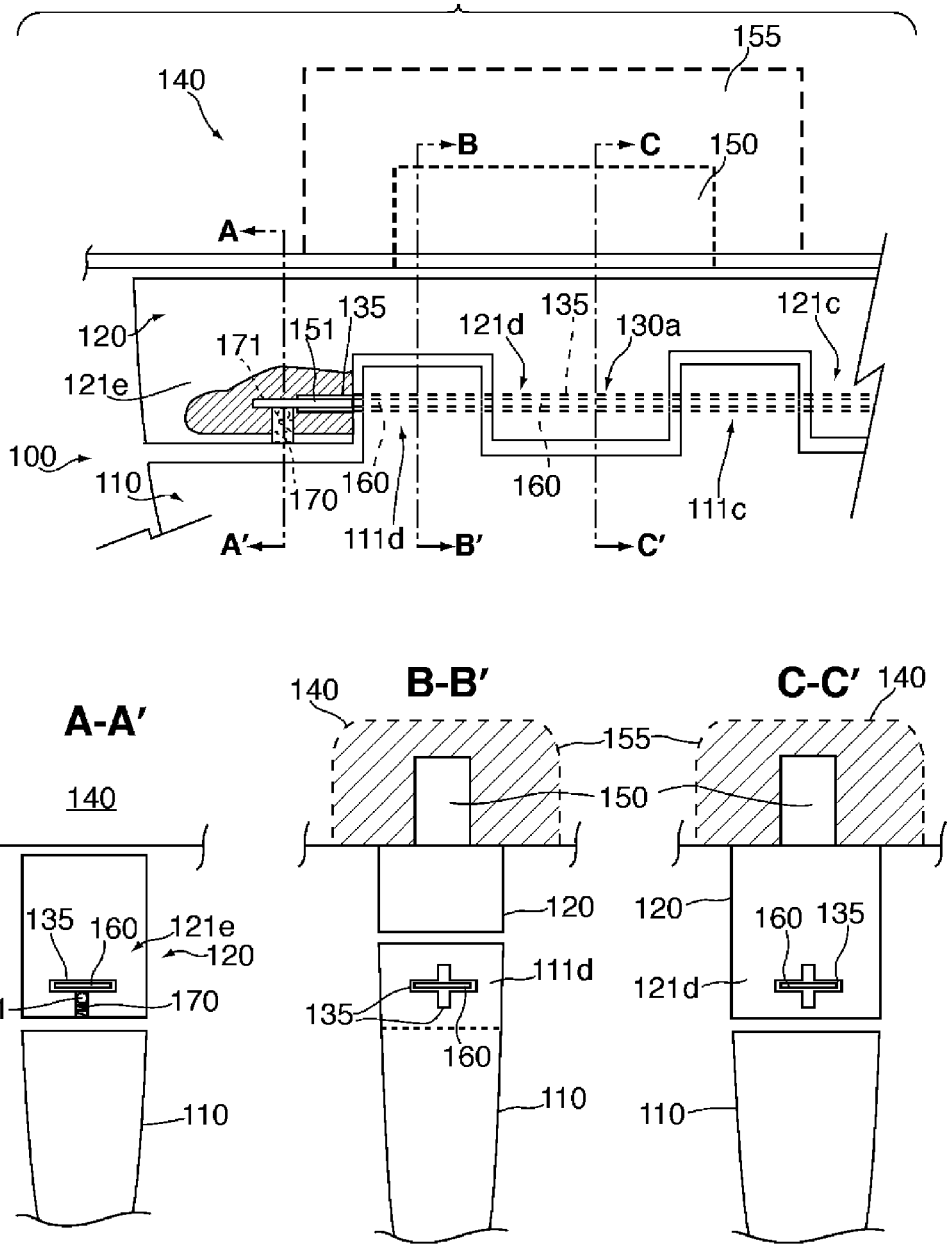

FIGS. 4 and 5 illustrate two suitable approaches for secure, fixed attachment of a fin body (110) to a fin base (120). One such approach, shown in FIG. 4, utilizes a hinge pin (130*a*) having a threaded distal end (131) that is screwed into a complementary threaded region (hatched cut-away area in FIG. 4) in the central bore (112) of the coupling element (121*e*) of the fin base (120). Tightening the threaded hinge pin into the fin base locks the complementary rectangular sections of the fin base (120) and fin body (110) into fixed, secure association that substantially prevents movement of the fin body (110) in relation to the fin base (120) by rotation of the fin body (110) about the axis of rotation (140).

Another representative approach for securing a fin body (110) to a fin base (120) is depicted in FIG. 5, where a flat pin (160) can be used to secure a fin body (110) in at least two different positions in relation to the fin base (120). In these and related embodiments, the flat pin (160) can be retained in the fin using any suitable retainer (170), such as a detent (not shown) in the distal end (161) of the flat pin (160) and a spring-loaded bearing member such as a stainless steel ball bearing (not shown) mounted in a suitable corresponding location in the fin base (120).

Also shown in FIG. 5 are three cross-sections taken through planes A-A', B-B', and C-C'. Section A-A' is a vertical section taken perpendicular the central longitudinal axis of the surfboard, thereby providing a cutaway through the surfboard (140), the leading coupling element (121*e*) of the fin base (120), and the front portion of the fin body (110). Also visible in this cutaway is the central bore (135) configured to receive the flat pin (160). This cutaway also shows a retainer (170) to secure the flat pin (160) so as to prevent its loss. In this embodiment the retainer includes a spring-loaded stainless steel ball bearing (171) adapted to releasably engage a detent (not shown) in the distal end (161) of the flat pin (160)

to secure the flat pin (160) yet facilitate its ready removal in order to allow the fin body (110) to be moved from one position (e.g., a surfing position) to another position (e.g., a storage position), when desired.

Section B-B' of FIG. 5 is another vertical section substantially parallel to and aft of Section A-A'. This section provides a cutaway through the surfboard (140), the coupling element (111*d*) of the fin body (110), and the fin base (120). Also visible in this section is a protruding anchoring post (150) inserted into its corresponding recessed port (155, hatched region) integrally flush-mounted into the underside of the surfboard (140). As shown in this section, in this embodiment the central bore (135) in the coupling elements (111*d* being shown) of the fin body (110) is a cross-pattern that results from the intersection of two flat channels offset from each other by 90 degrees. As will be appreciated, this configuration allows the fin body (110) to be positioned either vertically (as shown) or horizontally. To change the position of the fin body (110) relative to the fin base (120) and surfboard (140), force is applied to the gripping end (not shown) of the flat pin (160) sufficient to overcome the retaining force exerted on the flat pin by the retainer (170) and withdraw the flat pin from the central bore (135) of the fin assembly. The fin body may then be lifted slightly, rotated 90 degrees about the axis defined by the central bore, and re-associated with the fin base (120) such that the coupling elements (111, 121) of the fin body (110) and fin base (120) sufficiently align to allow the flat pin (160) to be completely re-inserted into the central bore so as to allow the retainer (170) to again retainingly engage its distal end (161).

Section C-C' of FIG. 5 is another vertical section substantially parallel to and aft of Section B-B'. This section provides a cutaway through the surfboard (140), the coupling element (121*d*) of the fin base (120), and the fin body (110). As with Section A-A', this view also shows the central bore (135), which has only a single, horizontally arrayed rectangular channel configured to receive the flat pin (160).

Figure 6:
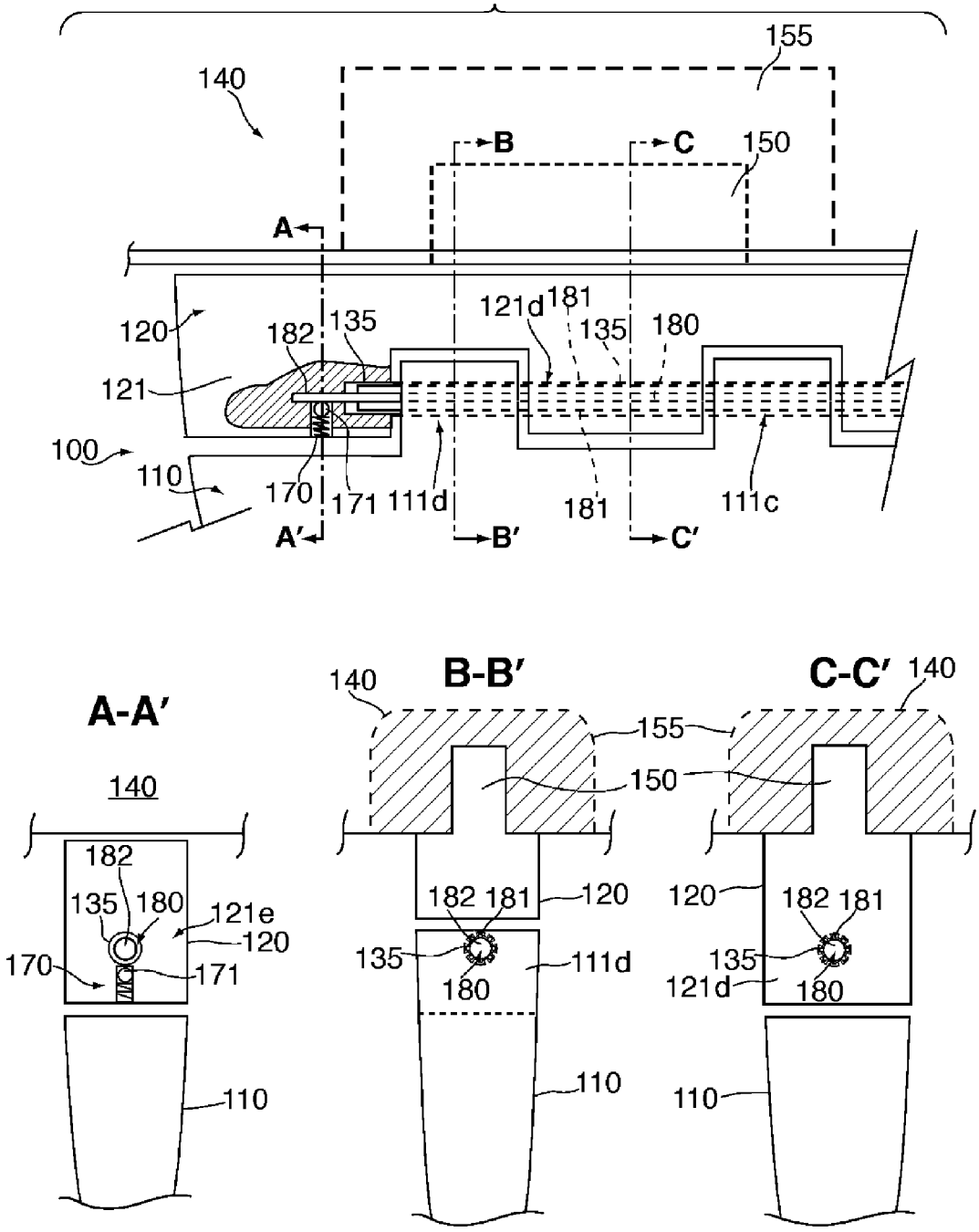

As those in the art will appreciate, an alternative to a flat pin as shown in FIG. 5 is a splined pin that can be inserted into central bores of a fin base and fin body adapted to engage the splines on the pin. Such a splined embodiment is depicted in FIG. 6. As those in the art will appreciate, such splined systems (i.e., those involving splined pins and central bores having complementary structures configured to engage the splines) provide foldable fins that can be fixed or secured in relation the surfboard in any number of multiple positions, including 2, 3, 4, 5, 6, 7, 8, 9, 10, or more different positions, at least one of which is a folded position and another (and perhaps all of the rest) of which is a surfing position. Embodiments particularly well suited for use of a splined system for securing a fin body to a fin base are described in Example 2, below, which features hinged surfboards fins that employ hinges wherein the coupling elements form a hinge having a barrel configuration.

Example 2

Hinged Surfborad Fin Utilizing Splined Shaft

Another embodiment analogous to those described in Example 1 employs a splined pin to secure a fin body (110) to a fin base (120). Such an embodiment is depicted in FIG. 6. Unlike the flat pin embodiment detailed in Example 1, more than two secure, fixed fin body positions can be achieved using a splined system, where the number of positions depends on the number of splines used. In these and related embodiments, the splined pin or shaft (180) can be retained in the fin using any suitable retainer (170), such as a detent (not shown) in the distal end (182) of the pin (180) adapted to be retained by the selected retaining system, for example, a spring-loaded bearing member (e.g., a stainless steel ball bearing (not shown)) mounted in a suitable corresponding location in the fin base (120). In this particular embodiment, the distal end (182) of the shaft (180) is preferably not splined in the region intended to be engaged by the retainer (170).

Also shown in FIG. 6 are three cross-sections taken through planes A-A', B-B', and C-C'. Section A-A' is a vertical section taken perpendicular the central longitudinal axis of the surfboard, thereby providing a cutaway through the surfboard (140), the leading coupling element (121*e*) of the fin base (120), and the front portion of the fin body (110). Also visible in this cutaway is the distal, unsplined end (182) of the shaft (180) being engaged by the spring-loaded ball bearing (171) of the retainer (170) adapted to releasably engage a detent (not shown) in the distal end (182) of the shaft (180) so as to secure the shaft (160) while at the same time facilitating its ready removal in order to allow the fin body (110) to be moved from one position (e.g., a surfing position) to another position (e.g., a storage position, a tilted position, etc.), when desired. The bore configured to receive the shaft is also shown, albeit in an exaggerated manner so that it can easily be seen in the drawing.

Section B-B' of FIG. 6 is another vertical section substantially parallel to and aft of Section A-A'. This section provides a cutaway through the surfboard (140), the coupling element (111*d*) of the fin body (110), and the fin base (120). Also visible in this section is a protruding anchoring post (150) inserted into its corresponding recessed port (155, hatched region) integrally flush-mounted into the underside of the surfboard (140). As shown in this section, in this embodiment the central bore (135) in the coupling elements (111*d* being shown) of the fin body (110) has a configuration complementary to the splines (181) of the shaft (180) in order to provide a capability for a plurality of fixed, secure positions between the fin base (120) and fin body (110). As will be appreciated, this configuration allows the fin body (110) to be positioned at several angles relative to the fin base (120), including vertically (as shown), horizontally, and at intermediate positions. To change the position of the fin body (110) relative to the fin base (120) and surfboard (140), force is applied to the gripping end (not shown) of the splined shaft (180) sufficient to overcome the retaining force exerted on the distal end (182) of the shaft (180) by the retainer (170) and withdraw the shaft from the central bore (135) of the fin assembly. The fin body may then be rotated about the axis defined by the central bore, and re-associated with the fin base (120) such that the coupling elements (111, 121) of the fin body (110) and fin base (120) sufficiently align to allow the splined shaft (180) to align with complementary spline-receiving channels of the central bore so that the shaft (180) be completely re-inserted into the central bore so as to allow the retainer (170) to again retainingly engage its distal end (182). If more intermediate positions between vertical and horizontal are desired, it is preferable (not shown in the drawings) that the facing surfaces of the coupling elements of the fin body and fin base be contoured to promote relative rotation without a requirement for moving the fin body away from the fin base before folding or rotation.

Section C-C' of FIG. 6 is another vertical section substantially parallel to and aft of Section B-B'. This section provides a cutaway through the surfboard (140), the coupling element (121*d*) of the fin base (120), and the fin body (110). As with Section A-A', this view also shows the splined shaft (180) and central bore (135) having complementary spline-receiving channels.

All of the articles and methods described and claimed herein can be made and executed without undue experimentation in light of the present disclosure. While the invention has been described in terms of preferred embodiments, it will be apparent to those of skill in the art that variations may be applied without departing from the spirit and scope of the invention. All such variations and equivalents apparent to those skilled in the art, whether now existing or later developed, are deemed to be within the spirit and scope of the invention as defined by the appended claims.

All patents, patent applications, and publications mentioned in the specification are indicative of the levels of those of ordinary skill in the art to which the invention pertains. All patents, patent applications, and publications are herein incorporated by reference in their entirety for all purposes and to the same extent as if each individual publication was specifically and individually indicated to be incorporated by reference in its entirety for any and all purposes.

The invention illustratively described herein suitably may be practiced in the absence of any element(s) not specifically disclosed herein. Thus, for example, in each instance herein any of the terms "comprising", "consisting essentially of", and "consisting of" may be replaced with either of the other two terms. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A foldable watercraft fin, comprising:

a. a fin body comprising a first coupling element; and b. a fin base comprising a watercraft mount and a second coupling element adapted to receive the first coupling element of the fin body so that fin body can be fixedly coupled to the fin base in any of a plurality of positions, which plurality includes at least a fixed, laterally folded storage position and a fixed upright surfing position.

2. A foldable watercraft fin according to claim 1 mounted to a watercraft.

3. A foldable watercraft fin according to claim 1 that is a foldable surfboard fin, optionally mounted to a surfboard.

4. A foldable watercraft fin according to claim 1, wherein the first coupling element is a first hinge element and the second coupling element is a second hinge element adapted to movably mate with the first hinge element such that the first hinge element can move relative to the second hinge element about an axis of rotation of the hinge.

5. A watercraft comprising at least one foldable watercraft fin according to claim 1.

6. A watercraft according to claim 5 selected from the group consisting of a surfboard, paddleboard, and kayak.

7. A kit comprising a foldable watercraft fin according to claim 1 and retail packaging containing the foldable watercraft fin.

* * * * *